United States Patent [19]

Hauk

[11] Patent Number: 4,638,276

[45] Date of Patent: Jan. 20, 1987

[54] REED SWITCH WITH A HOUSING AND A PULSE GENERATOR

[75] Inventor: Klaus Hauk, Altrip, Fed. Rep. of Germany

[73] Assignee: Deere & Company, Moline, Ill.

[21] Appl. No.: 727,654

[22] Filed: Apr. 26, 1985

[51] Int. Cl.[4] ..... H01H 1/66; H01H 51/00

[52] U.S. Cl. ..... 335/151; 335/153; 335/205; 200/302.1; 200/81.9 M; 200/83 L

[58] Field of Search ..... 335/151, 153, 156, 205, 335/206, 207; 200/300, 306, 302.1, 302.2, 82 E, 81.9 M, 259, 61.88, 61.91, 83 L

[56] References Cited

U.S. PATENT DOCUMENTS

| | | | |
|---|---|---|---|
| 1,959,180 | 9/1933 | Stephens | 219/136 |
| 3,161,260 | 9/1962 | Benini | 188/78 |
| 3,421,124 | 1/1969 | Kidd | 335/205 |
| 4,481,806 | 11/1984 | Schad | 335/153 |
| 4,511,872 | 4/1985 | Olmsted et al. | 336/136 |

*Primary Examiner*—E. A. Goldberg
*Assistant Examiner*—Lincoln D. Donovan

[57] ABSTRACT

A reed switch includes a housing in which extends a stepped bore for slidably receiving a magnet carrying sleeve. The sleeve includes a longitudinal bore which receives a glass tube. The sleeve is slidable with respect to the glass tube. The glass tube encloses a switch element. The longitudinal bore is connected to the environment via pressure-equalizing bores in order to avoid the build-up of a high pressure or a vacuum inside the read switch. Collecting pockets for dirt particles are provided between the sleeve and the housing. The stepped bore opens at one end of the housing. The open end of the housing has an inner chamfer which forms an edge from which fluid easily falls away.

1 Claim, 2 Drawing Figures

REED SWITCH WITH A HOUSING AND A PULSE GENERATOR

BACKGROUND OF THE INVENTION

This invention concerns a reed switch with a permanent magnet movable within a housing.

Reed switches have switch contacts enclosed in a glass tube. The contacts are moved away from or toward each other under the influence of a magnetic field. The magnetic field is usually generated by a permanent magnet which is moved with respect to the contacts by means of a movable carrier sleeve.

Thus, with a known type of reed switch (see "Maschine und Werkzeug", Vol. 23, 1983), the magnet carrier is movable in a housing and it extends out of one end of the housing so that it can be moved relative to the glass tube by means of a switch fork or a switch rod, etc. The inner end of the magnet carrier sleeve encloses a permanent magnet which moves with respect to the contacts in order to connect or separate the contacts. There is a close fit between the sleeve and the housing to assure that no dirt particles or liquid can enter the gap between the housing and the sleeve.

Such a known reed switch can be used to control a starter circuit of a combustion engine for a vehicle with a transmission which can be operated only when the gear is in neutral. In this case, the reed switch is set up in such a way that the sleeve is moved to a position opposite the contacts by means of a switching mechanism which is in neutral position and thus, closes the starter circuit which had previously been interrupted. As a result of a wide variety of transmission designs, the reed switch must, in some cases, be installed at a location where it is constantly in contact with lubricant oil containing iron abrasion particles.

In such a case, it is possible for the sleeve to pump contaminated lubricant oil into the interior of the reed switch where it can be trapped, as is the case when the lubricant oil is exposed to low temperatures and is thus highly viscous. Furthermore, iron particles may collect on the lateral surface of the sleeve, owing to the magnetic field, and completely block any sliding motion.

SUMMARY OF THE INVENTION

The object of this invention is to provide an improved reed switch which is insensitive to contamination by lubricant oil and iron particles.

This object is achieved, according to this invention, by providing pockets in the sleeve for collecting foreign particles which might otherwise migrate to the slide surfaces. In this way, an effective measure is taken to prevent foreign substances which penetrate into the reed switch from covering the slide surface and thus, both wear on the sliding surfaces and the forces required to move the sleeve are reduced to a minimum. Furthermore, if the collecting pockets are located in the vicinity of the magnet, then the magnetic field will act to retain the iron-containing foreign bodies in the collecting pockets.

According to another feature of this invention, the collecting pockets are designed as grooves in the sleeve to permit easy entrance of the foreign particles. Since the collecting pockets are designed as longitudinal grooves cut in the lateral surface of the sleeve and/or the housing, the foreign particles are collected regularly whenever there is longitudinal sleeve movement. Thus, to prevent blockage of the collecting pockets, even when they have a low capacity and there is a high concentration of foreign particles, the collecting pockets are communicated with the outside of the housing via a passage so that constant drainage can occur. To prevent an excess pressure or a reduced pressure in the interior of the reed switch, a pressure-equalizing bore extends into the sleeve so that it communicates with atmosphere in at least one end position of the sleeve. It would also be possible, however, for the inside bore to be constantly ventilated and/or exhausted, which is especially advantageous if sliding between the sleeve and the housing is prevented by even a slight excess pressure or reduced pressure in the reed switch.

Ventilation and/or exhaust passages are provided directly beneath an operating surface near one end of the housing so that ventilation and/or exhaust is provided even if the reed switch is screwed into a housing and projects only a small distance above a wall of the housing.

Even if the reed switch is exposed to a large amount of lubricant oil or other liquids, their penetration into the reed switch beyond a certain extent is avoided with this invention. The housing has a bore open at one end so that the sleeve can move inside this bore. The open end is provided with a chamfer so that the apertures communicate with the open end. The chamfer forms an edge surrounding the open end which causes the liquid to drop away and largely prevents it from penetrating into the reed switch.

According to another feature of this invention, the inside bore may be communicated with the collecting pockets in such a way that foreign particles in the collecting pockets are washed out of the pockets by any liquid that enters and can be discharged to the environment through the apertures for ventilation and/or exhaust.

DETAILED DESCRIPTION

Figure 1:
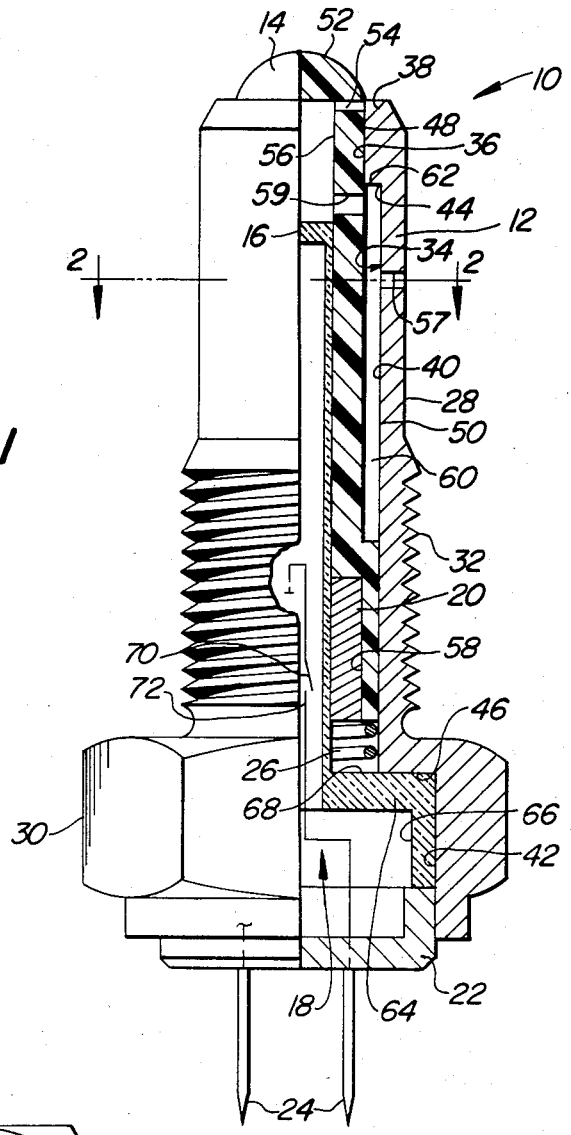
FIG. 1 is a partial sectional view of a reed switch according to this invention.
Figure 2:
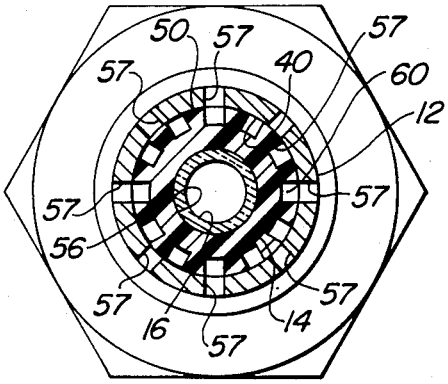
FIG. 2 is a cross-sectional view along lines 2—2 of FIG. 1.

A reed switch 10 has a housing 12, a magnet carrying sleeve 14, a glass tube 16 which encloses the contacts, a switch element 18, a ring magnet 20, a base 22, terminals 24 and a compression spring 26. In the following description, such terms as left, right, top and bottom refer to the view illustrated in the figure.

The housing 12 is preferably made of steel and consists of a cylindrical hollow body 28 and an integral hexagonal base 30 at the lower end of the body 28. However, it is also possible for this to be made of some other metal or a durable plastic. A thread 32, which is cut on the surface of hollow cylinder 28, ends directly above the transition from hexagonal base 30 to hollow cylinder 28 and extends from there along approximately half the length of hollow cylinder 28, making it possible to screw reed switch 10 into a housing or holder (not shown). At the upper end of hollow cylinder 28, a stepped bore 34 has a small diameter bore portion 36 which terminates in a 45 degree chamfer 38 which opens to the outside (the significance of this is to be explained later). Stepped bore 34 also has a medium diameter bore portion 40 and a large diameter bore portion 42, in which case, small diameter bore 36 constitutes about one-eighth of the length of hollow cylinder 28, while the medium diameter bore 40 follows it below and extends somewhat into the hexagonal base 30, and the large diameter bore 42 leads from there to the lower end of the hexagonal base 30. This yields an upper shoulder 44 at the transition from bore 36 to bore 40 and a lower shoulder 46 at the transition from bore 40 to bore 42.

Sleeve 14 can slide in step bore 34 and is provided with a small diameter section 48 and a large diameter section 50. The outside diameter of the sleeve section 48 corresponds approximately to the inside diameter of bore portion 36, while the sleeve section 50 has an outside diameter which corresponds to the inside diameter of bore portion 40. Thus, sleeve 14 sealingly slides in bore 34 between two end positions. The small diameter section 48 constitutes approximately one-fifth of the total length of sleeve 14 and has a hemispherical cap 52 at its upper end. Several radial-pressure equalizing bores 54 extend from the outside of section 48 to a stepped inside bore with small and large diameter portions 56 and 58, respectively, in sleeve 14. However, it is also feasible for hemispherical cap 52, instead of pressure-equalizing bores 54, to be designed so as to be largely open in the direction of small bore 56. However, if pressure-equalizing bores 54 are provided, then measures must be taken to assure that there is a connection between small bore 56 and the environment, at least in one end position of sleeve 14. As a practical matter, since sleeve 14 can only be moved a few milimeters against the bias of spring 26, bore 56 will always be communicated with the envirqnment via bores or passages 54. This small bore 56 runs from beneath the cap 52 to the lower edge of large diameter section 50, and joins large bore 58 which receives a ring magnet 20. Several diametrically opposed pockets 60 are cut along the longitudinal axis in the surface of the large diameter section 50 from beneath the small diameter section 48 to approximately the level of large bore 58. These pockets are provided to catch dirt and iron particles, as described below. The upper end of pocket 60 also marks the transition between the small diameter section 48 and the large diameter section 50. The upper end of large diameter section 50 forms an abutment which can be brought to rest against the shoulder 44. The pockets 60, which can be regarded as collecting pockets for foreign particles, thus communicate with the slide surface and during the sliding operation, they collect dirt particles that have been deposited on the surface. A similar effect would also occur if the pockets were cut in the inside wall of housing 12. In addition, a constant drainage to the environment of the reed switch 10 could also be provided by means of passages 57, such as slits or bores in housing 12 opening to pockets 60. This drainage could also be achieved by passages 59 which would communicate the pockets 60 with bore 56 so that dirt particles collected therein could be washed out by means of the liquid passing through bore 56 and bores 54. The ring magnet 20 is held in bore 58 by means of an adhesive or a force fit and at its lower end, is flush with the wide position section 50, sealing it off. Its inside diameter thus corresponds to the diameter of bore 56.

Glass tube 16 is received in bore 56 and has an outside diameter for about 5/6 of its length which also approximately corresponds to the inside diameter of bore 56. The lower end of tube 16 is widened to form a cylindrical base 64 which is received by bore 42. A bore 66 extends into base 64 and receives a portion of switch element 18. This shape results in a shoulder 68 which rests against the lower shoulder 46. The glass tube 16 is filled with safety gas and encloses switch element 18 which includes two conductor ends 70 and 72 which can be brought in contact, depending upon the position of the ring magnet 20 and its associated magnetic field. The conductor ends 70 and 72 lead to the base 22 and may be connected to a suitable electric power source (not shown) via terminals 24 which project from base 22.

Finally, compression spring 26 is between the lower end of sleeve 14 and the shoulder 68 to urge sleeve 14 away from shoulder 68.

Glass tube 16, housing 12, base 22 and switch element 18 are fixed with respect to each other to form an assembly with respect to which only sleeve 14 and ring magnet 20, under the influence of compression spring 26, can move. This movement is in the direction of the central longitudinal axis of reed switch 10.

Sleeve 14 projects with its cap 52 out of casing 12 and thus, can be acted on by an external force to impart a movement, optionally initiated by means of a switch fork, a switch rod, a lever, a pedal or many other devices (not shown). Due to the compression spring 26 at one end and the fact that shoulder 62 comes to rest against shoulder 44 at the other end, the movement of sleeve 14 is limited to between an upper and a lower end position. This movement is only large enough for cap 52 to just project above housing 12 when spring 26 is fully compressed. Depending on whether sleeve 14, and thus, also ring magnet 20, are in their upper or lower end positions, switch element 18 is closed or opened due to the position of the magnetic field built up inside ring magnet 20 with respect to conductor ends 70, 72.

This reed switch 10 may be used to control a starter circuit (not shown) of a combustion engine (not shown) for a tractor with a gear which, for safety reasons, can be started only by means of an electric starting motor (not shown) when the gear is in neutral. However, if the transmission is in a gear, then ring magnet 20, with sleeve 14, should have a position which causes switch element 18 to be open so no current can flow from an ignition lock to the electric starter motor. Therefore, a sliding selector shaft (not shown) is set on a cam (not shown) which drives sleeve 14 into housing 12 as long as the selector shaft is in neutral position. In this position, switch element 18 is closed and the combustion engine can be started. However, when reed switch 10 is built into the transmission, it is exposed to lubricant oil and particles of iron abrasion contained therein. Due to the relative movement of sleeve 14 with respect to glass tube 16 and housing 12, and the resulting gap between them, regardless of how small, a pumping action occurs with each stroke of the sleeve 14, causing lubricant oil to be drawn into the gap, together with the above-mentioned iron particles and other deposits. To prevent this lubricant oil from being trapped between the glass tube 16 and the upper end of longitudinal bore 56, pressure-equalizing bores 54 are provided for the lubricant oil to be pumped out again. Furthermore, the 45 degree chamfer 38 at the upper end of housing 12 results in an edge from which the lubricant oil easily drops away when the reed switch 109 is installed in horizontal or tilted position and thus, it is almost impossible for lubricant oil to penetrate into the gap. Any particles which nevertheless penetrate into the gap between sleeve 14 and housing 12 are deposited in the pockets 60 and do not block movement of sleeve 14.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. A reed switch comprising:

a hollow cylindrical housing having an axial bore therein with larger and smaller diameter bore portions;

a switch element supported within the housing;

a hollow cylindrical magnet carrier movable in the housing and having larger and smaller outer diameter sections, the larger section slidably engaging a wall of the larger bore portion of the housing, the smaller section slidably and sealingly engaging a wall of the smaller bore portion of the housing, the carrier including a blind bore extending therein for slidably receiving the switch element, the carrier and the switch element cooperating to define a variable volume chamber therebetween within the carrier at one end thereof, the larger diameter section of the carrier having a plurality of peripherally spaced apart, axially extending grooves in an outer surface thereof, the carrier having a first passage extending therethrough from the chamber to an outer surface of its smaller diameter section, the carrier having a second passage extending therethrough from the chamber to one of the grooves in the larger diameter section, the carrier being movable in the housing between an inner and an outer position therein, the resilient means urging the carrier to its outer position.

* * * * *